US010617190B2

(12) United States Patent
Hsu

(10) Patent No.: US 10,617,190 B2
(45) Date of Patent: Apr. 14, 2020

(54) HAIR CLAMPING DEVICE

(71) Applicant: Shih-Ling Hsu, Tainan (TW)

(72) Inventor: Shih-Ling Hsu, Tainan (TW)

( * ) Notice: Subject to any disclaimer, the term of this patent is extended or adjusted under 35 U.S.C. 154(b) by 684 days.

(21) Appl. No.: 15/229,253

(22) Filed: Aug. 5, 2016

(65) Prior Publication Data

US 2017/0055666 A1 Mar. 2, 2017

(30) Foreign Application Priority Data

Aug. 26, 2015 (TW) ..... 104128004 A

(51) Int. Cl.
*A45D 8/20* (2006.01)
*A45D 8/34* (2006.01)

(52) U.S. Cl.
CPC ..... *A45D 8/20* (2013.01); *A45D 8/34* (2013.01); *Y10T 24/14* (2015.01); *Y10T 24/15* (2015.01); *Y10T 24/157* (2015.01); *Y10T 24/39* (2015.01)

(58) Field of Classification Search
CPC ... A45D 8/20; A45D 8/22; A45D 8/24; A45D 8/28; A45D 8/34; A45D 8/36; Y10T 24/14; Y10T 24/1402; Y10T 24/141; Y10T 24/15; Y10T 24/157; Y10T 24/3936; Y10T 24/3949; Y10T 24/3956; Y10T 24/44239; Y10T 24/44275; Y10T 24/44291; Y10T 24/4453; Y10T 24/44538; Y10T 24/44769; Y10T 24/44855
See application file for complete search history.

(56) References Cited

U.S. PATENT DOCUMENTS 1,811,842 A * 6/1931 Bossart ..... A45D 8/34 132/273
2,838,056 A * 6/1958 Kertesz ..... A45D 8/20 132/277
4,835,820 A * 6/1989 Robbins, III ..... B65D 33/1675 24/30.5 R
5,588,622 A * 12/1996 Gordon, Sr. ..... B65B 67/1238 24/30.5 R
2006/0096609 A1* 5/2006 Nwokola ..... A41G 5/0026 132/201

(Continued)

FOREIGN PATENT DOCUMENTS

DE 453298 * 12/1927 ..... A45D 8/34
WO WO2005117638 * 12/2005 ..... A45D 8/00

*Primary Examiner* — Tatiana L Nobrega
(74) *Attorney, Agent, or Firm* — Alan D. Kamrath; Karin L. Williams; Mayer & Williams PC

(57) ABSTRACT

A hair clamping device includes a clamping member and a stretching member. The clamping member is a flexible arcuate member including first and second engaging ends releasably engaged with each other. The clamping member is in an extended state when the first and second engaging ends disengage from each other. The clamping member is in a clamping state when the first and second ends engage with each other. The clamping member in the clamping state defines an annular through-hole in a central portion thereof. The stretching member has an outer diameter smaller than a diameter of the through-hole of the clamping member in the clamping state. The stretching member includes an outer surface connected to an inner face of the clamping member. A hair clamping slot is defined between the inner face of the clamping member and the outer surface of the stretching member in the clamping state.

4 Claims, 5 Drawing Sheets

(56) References Cited

U.S. PATENT DOCUMENTS

| | | | | |
|---|---|---|---|---|
| 2007/0028940 | A1* | 2/2007 | Coral | A45D 8/20 132/277 |
| 2010/0252064 | A1* | 10/2010 | Shyu | A45D 8/36 132/273 |
| 2013/0086774 | A1* | 4/2013 | Krasinski | A45C 13/001 24/16 R |
| 2013/0160784 | A1* | 6/2013 | Loredo | A45D 8/28 132/200 |
| 2013/0263884 | A1* | 10/2013 | Hogan | A45D 8/34 132/273 |
| 2014/0283869 | A1* | 9/2014 | Sonstegard | A45D 8/34 132/275 |
| 2015/0250282 | A1* | 9/2015 | Hsu | A45D 8/20 132/277 |

* cited by examiner

X - X

HAIR CLAMPING DEVICE

BACKGROUND OF THE INVENTION

The present invention relates to a hair clamping device and, more particularly, to a hair clamping device providing improved hair clamping effect and providing a better hairstyle quality.

Women with long hair generally use a hair clamping device to hold the hair. There are various types of hair clamping devices. A type of hair clamping device is annular and made of elastic material. In use, the hair of a user extends through a central hole of the hair clamping device and is held by the hair clamping device that returns to its original shape after the hair has passed. However, the hair clamping device is apt to fall from the hair if the amount of hair held by the hair clamping device is insufficient. Furthermore, the diameter of the hair holding device holding the hair is small, such that a portion of the hair behind the hair clamping device gives an impression of tightness, failing to present a fluffy hairstyle.

Another type of hair clamping device is an arcuate member having two buckles respectively on two ends thereof. The hair is received in the hair clamping device in an extended state, and the buckles on the two ends of the hair clamping device are then coupled with each other to form a loop for holding the hair. However, the hair clamping device is apt to fall from the hair if the amount of hair held by the hair clamping device is insufficient. Furthermore, a portion of the hair behind the hair clamping device gives an impression of tightness, failing to present a fluffy hairstyle.

Thus, a need exists for a novel hair clamping device that mitigates and/or obviates the above disadvantages.

BRIEF SUMMARY OF THE INVENTION

A hair clamping device according to the present invention includes a hair clamping device providing a reliable hair clamping effect, providing a better hairstyle quality, and presenting a visual effect of an increased amount of hair held by the hair clamping device.

A hair clamping device according to the present invention includes a clamping member and a stretching member. The clamping member is a flexible arcuate member including outer and inner faces and first and second engaging ends releasably engaged with each other. The clamping member is in an extended state when the first and second engaging ends disengage from each other. The clamping member is in a clamping state when the first and second ends engage with each other. The clamping member in the clamping state defines a through-hole in a central portion thereof. The through-hole is annular. The stretching member has an outer diameter smaller than a diameter of the through-hole of the clamping member in the clamping state. The stretching member includes an outer surface connected to the inner face of the clamping member. A hair clamping slot is defined between the inner face of the clamping member and the outer surface of the stretching member when the first and second engaging ends of the clamping member engage with each other.

In an example, the outer surface of the stretching member is askew to a longitudinal axis of the through-hole of the clamping member. The stretching member has increasing diameters from a side of the stretching member toward the other side of the stretching member.

In an example, the stretching member and the clamping member are integrally formed as a single, inseparable member.

In an example, the stretching member is hollow.

In an example, each of the first and second engaging ends have inner and outer sides. The inner sides of the first and second engaging ends face each other when the clamping member is in the extended state. The outer sides of the first and second engaging ends engage with each other when the clamping member is in the clamping state.

In use of the hair clamping device according to the present invention, the side of the stretching member with a smaller diameter is moved close to a head of a user, and the clamping member in the extended state is used to hold the hair of the user. The hair can be clamped between the inner face of the clamping member and the outer surface of the stretching member. Then, the first and second engaging ends of the clamping member engage with each other to securely clamp the hair in the hair clamping slot. Since the volume of the hair clamping slot is smaller than the volume of the through-hole, a bunch of hair smaller than the diameter of the through-hole can be securely clamped between the inner face of the clamping member and the outer surface of the stretching member without the risk of falling. Furthermore, the clamping member in the hair clamping position has an outer diameter to increase a visual effect of an increased amount of hair.

Furthermore, a center of the hair behind the clamping member can spread toward a rear end of the stretching member and can cover the stretching member. Furthermore, an outer side of the hair can spread toward the outer side of the clamping member. Since the outer surface of the stretching member has an increasing diameter toward the outer side, the hair can be guided to spread outward more quickly, presenting a fluffy hairstyle after clamping the hair. In comparison with conventional hair clamping devices, the hair clamping device according to the present invention provides a reliable hair clamping effect, provides a better hairstyle quality, and presents a visual effect of an increased amount of hair held by the hair clamping device.

The present invention will become clearer in light of the following detailed description of illustrative embodiments of this invention described in connection with the drawings.

DETAILED DESCRIPTION OF THE INVENTION

Figure 1:
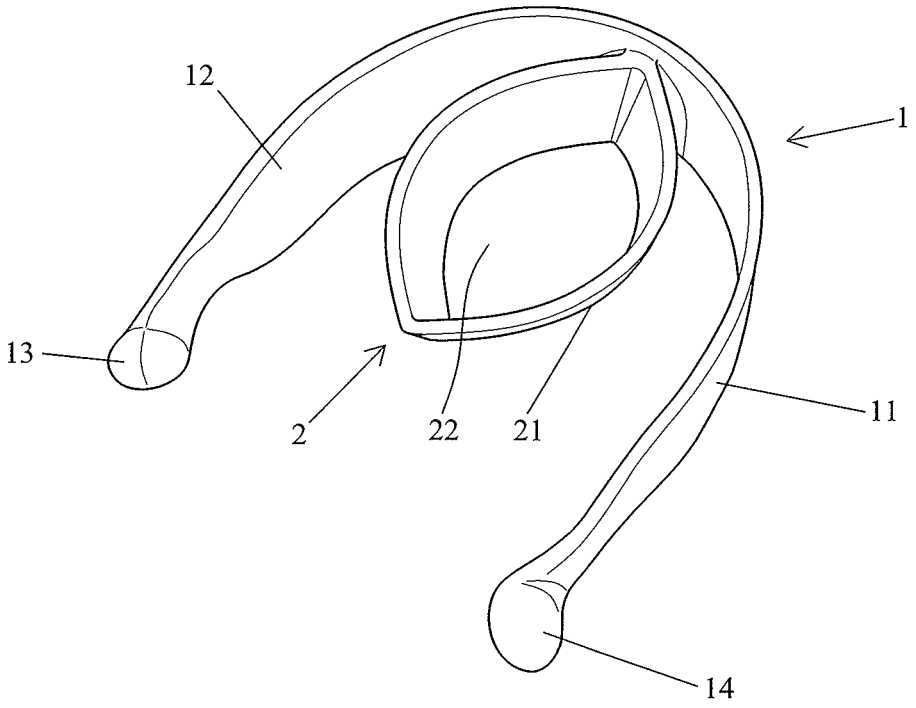
FIG. 1 is a perspective view of a hair clamping device according to the present invention.
Figure 2:
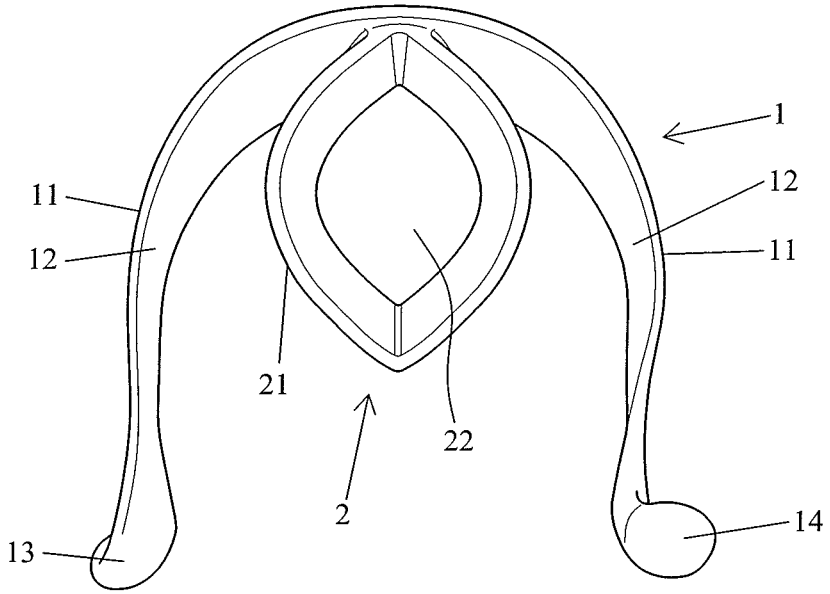
FIG. 2 is a front elevational view of the hair clamping device in an extended state.
Figure 3:
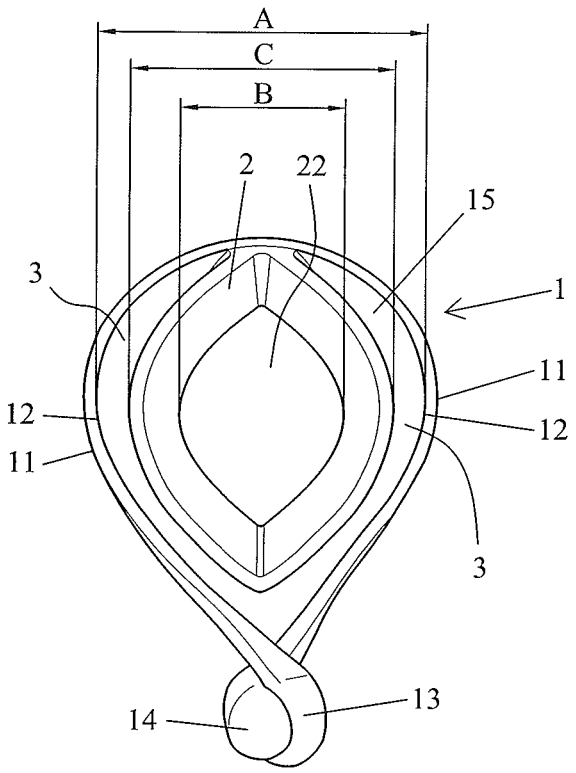
FIG. 3 is a front elevational view of the hair clamping device in a coupled state.

With reference to FIGS. 1-3, a hair clamping device according to the present invention includes a clamping member 1 and a stretching member 2. The clamping member 1 is a flexible arcuate member including outer and inner faces 11 and 12 and first and second engaging ends 13 and 14 releasably engaged with each other. The clamping member 1 is in an extended state when the first and second engaging ends 13 and 14 disengage from each other. The clamping member 1 is in a clamping state when the first and second ends 13 and 14 engage with each other. The clamping member 1 in the clamping state defines a through-hole 15 in a central portion thereof. The through-hole 15 is annular.

In this embodiment, each of the first and second engaging ends 13 and 14 have inner and outer sides. The inner sides of the first and second engaging ends 13 and 14 face each other when the clamping member 1 is in the extended state. The outer sides of the first and second engaging ends 13 and 14 engage with each other when the clamping member 1 is in the clamping state. Nevertheless, the first and second engaging ends 13 and 14 can be of any coupling mechanism defining the through-hole 15 after engagement.

The stretching member 2 has an outer diameter smaller than a diameter of the through-hole 15 of the clamping member 1 in the clamping state. The stretching member 2 includes an outer surface 21 connected to the inner face 12 of the clamping member 1. A hair clamping slot 3 is defined between the inner face 12 of the clamping member 1 and the outer surface 21 of the stretching member 2 when the first and second engaging ends 13 and 14 of the clamping member 1 engage with each other.

The stretching member 2 and the clamping member 1 can be integrally formed as a single, inseparable member. Alternatively, the stretching member 2 and the clamping member 1 can be separate members coupled with each other by any suitable provision. The outer surface 21 of the stretching member 2 can be connected to an intermediate portion of the inner face 12 of the clamping member 1. As shown in FIG. 3, when the first and second engaging ends 13 and 14 of the clamping member 1 engage with each other, a volume of a portion of the hair clamping slot 3 on the left side of the stretching member 2 is substantially equal to a volume of another portion of the hair clamping slot 3 on the right side of the stretching member 2. Furthermore, the stretching member 2 is hollow and includes a central hole 22 to reduce the weight and the material cost.

The outer surface 21 of the stretching member 2 is askew to a longitudinal axis of the through-hole 15 of the clamping member 1. Furthermore, the outer surface 21 of the stretching member 2 has increasing diameters away from the longitudinal axis of the through-hole 15 (the diameter B at a side of stretching member 2 is smaller than the diameter C at the other side of the stretching member 2, as shown in FIG. 3).

Figure 4:
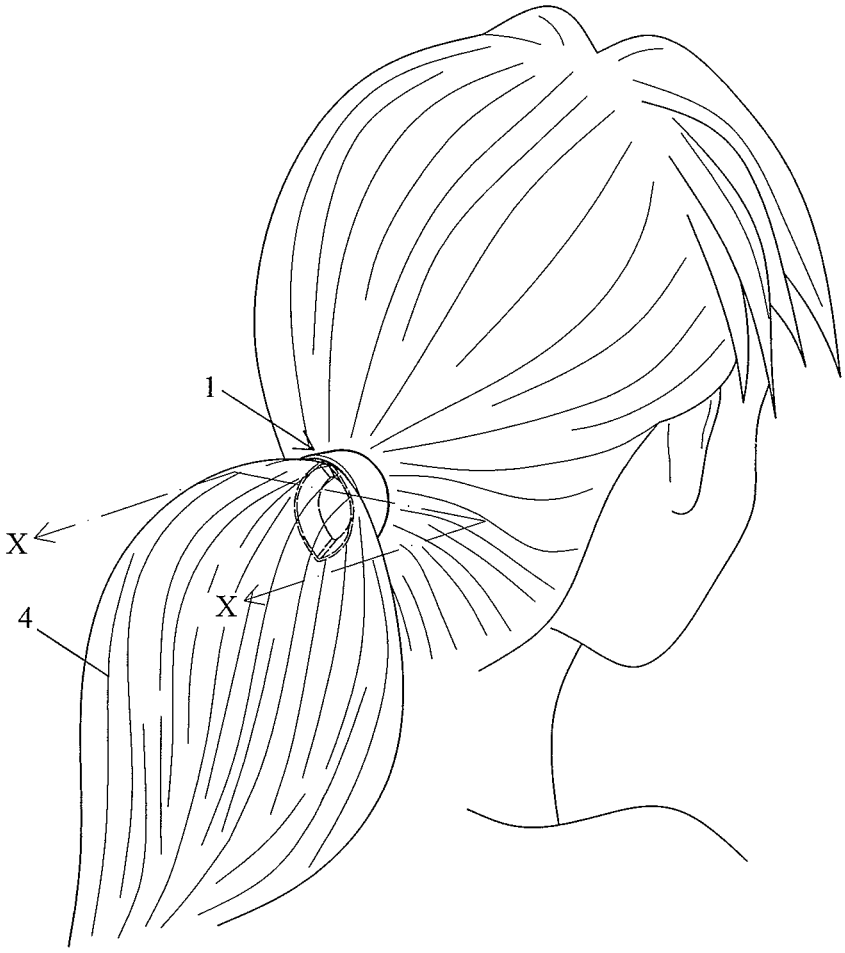
FIG. 4 is a diagrammatic perspective view illustrating use of the hair clamping device.
Figure 5:
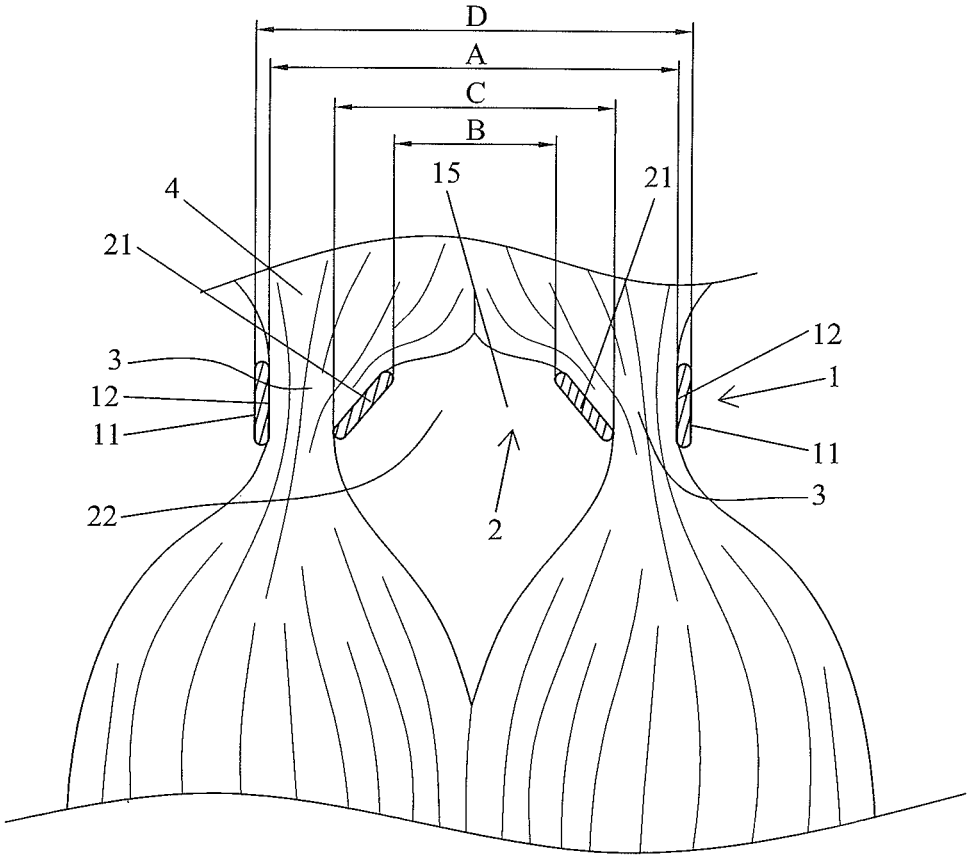
FIG. 5 is a cross sectional view taken along section line X-X of FIG. 4.

With reference to FIGS. 4 and 5, in use of the hair clamping device according to the present invention, the side of the stretching member 2 with the smaller diameter B is moved close to a head of a user, and the clamping member 1 in the extended state is used to hold the hair of the user. The hair 4 can be clamped between the inner face 12 of the clamping member 1 and the outer surface 21 of the stretching member 2. Then, the first and second engaging ends 13 and 14 of the clamping member 1 engage with each other to securely clamp the hair 4 in the hair clamping slot 3. Since the volume of the hair clamping slot 3 is smaller than the volume of the through-hole 15, a bunch of hair smaller than the diameter A of the through-hole 15 can be securely clamped between the inner face 12 of the clamping member 1 and the outer surface 21 of the stretching member 2 without the risk of falling. Furthermore, the clamping member 1 in the hair clamping position has an outer diameter D to increase a visual effect of an increased amount of hair.

Furthermore, a center of the hair behind the clamping member 1 can spread toward a rear end of the stretching member 2 and can cover the stretching member 2. Furthermore, an outer side of the hair can spread toward the outer side of the clamping member 1. Since the outer surface 21 of the stretching member 2 has increasing diameter toward the outer side, the hair 4 can be guided to spread outward more quickly, presenting a fluffy hairstyle after clamping the hair 4. In comparison with conventional hair clamping devices, the hair clamping device according to the present invention provides a reliable hair clamping effect, provides a better hairstyle quality, and presents a visual effect of an increased amount of hair held by the hair clamping device.

In view of the foregoing, the hair clamping device according to the present invention is a novel design providing a reliable hair clamping effect, providing a better hairstyle quality, and presenting a visual effect of an increased amount of hair held by the hair clamping device, which obviously helps users with thin hair.

Although specific embodiments have been illustrated and described, numerous modifications and variations are still possible without departing from the scope of the invention. The scope of the invention is limited by the accompanying claims.

The invention claimed is:

1. A hair clamping device, comprising:

a clamping member formed as an arcuate band with opposing first and second engaging ends, the clamping member being flexible and defining opposing top and bottom faces joined by opposing lateral outer and inner faces; and a stretching member defining opposing top and bottom faces joined by opposing lateral outer and inner faces, where the stretching member is annular and the outer face is joined at one end thereof to a central portion of the inner face of the clamping member, wherein the hair clamping device is alterable between i) an extended state in which the first and second engaging ends are disengaged from each other and ii) a clamping state in which the first and second engaging ends are engaged and substantially aligned along a longitudinal axis with the one end of the stretching member and the central portion of the clamping member, and in the clamping state, the clamping member defines a through-hole in which the stretching member is disposed such that the stretching member has an outer diameter defined by the outer face thereof which is smaller than an inner diameter defined by the inner face of the clamping member providing a gap between the inner face of the clamping member and the outer face of the stretching member wherein the stretching member is askew to the longitudinal axis such that the outer diameter of the stretching member increases from the bottom face of the stretching member toward the top face of the stretching member; and during use, the bottom faces of the clamping and stretching members are oriented facing a user's scalp, a user's hair is inserted within the gap and the first and second engaging ends are placed in engagement to clamp the hair between the inner surface of the clamping member and the outer surface of the stretching member such that the hair fans out toward the top surfaces of the clamping and stretching members and covers the stretching member.

2. The hair clamping device as claimed in claim 1, wherein the stretching member and the clamping member are integrally formed as a single, inseparable member.

3. The hair clamping device as claimed in claim 2, wherein the stretching member is hollow.

4. The hair clamping device as claimed in claim 1, wherein each of the first and second engaging ends have inner and outer sides, the inner sides of the first and second engaging ends face each other when the clamping member is in the extended state, and the outer sides of the first and second engaging ends engage with each other when the clamping member is in the clamping state.

* * * * *